US005226548A

United States Patent [19]

Koeppel

[11] Patent Number: 5,226,548

[45] Date of Patent: Jul. 13, 1993

[54] I-FRAME SUPPORT FOR A ROTATABLE DISPLAY TOWER

[75] Inventor: Lloyd Koeppel, North Freedom, Wis.

[73] Assignee: Gressco, Ltd., Waunakee, Wis.

[21] Appl. No.: 806,713

[22] Filed: Dec. 12, 1991

[51] Int. Cl.[5] ..... A47F 5/02

[52] U.S. Cl. ..... 211/144; 211/163; 211/169

[58] Field of Search ..... 211/163, 198, 199, 169, 211/40, 41, 144; D6/407; 160/135

[56] References Cited

U.S. PATENT DOCUMENTS

| | | | |
|---|---|---|---|
| D. 285,881 | 9/1986 | Mt. Pleasant et al. | D6/407 X |
| D. 285,882 | 9/1986 | Mt. Pleasant et al. | D6/407 X |
| 646,388 | 3/1900 | Moore | 211/163 |
| 1,635,573 | 7/1927 | Bertram | 160/135 |
| 1,697,277 | 1/1929 | Hoopes | 160/135 |
| 2,194,238 | 3/1940 | Weaver | 211/169 X |
| 2,525,683 | 10/1950 | Keely | 160/135 |
| 2,701,928 | 2/1955 | Kennan et al. | 211/163 X |
| 3,759,396 | 9/1973 | Best et al. | 211/169 X |
| 3,924,749 | 12/1975 | Weston | 211/169 X |
| 4,250,676 | 2/1981 | Presby | 160/135 X |
| 4,761,922 | 8/1988 | Black | 160/135 X |
| 5,118,176 | 6/1992 | Motley et al. | 211/163 X |

*Primary Examiner*—David A. Scherbel
*Assistant Examiner*—Korie H. Chan
*Attorney, Agent, or Firm*—Henry R. Lerner

[57] ABSTRACT

A display rack for books, cassette tapes, compact disks, LP records, etc. comprises an I-frame support for at least two rotatable towers housed thereon. Two or more I-frames and towers are hinged together with the towers supported therebetween for rotation. With the I-frames connected together an extremely versatile structure is presented which enables the display to assume a wide variety of spatial configurations.

6 Claims, 3 Drawing Sheets

FIG. 4
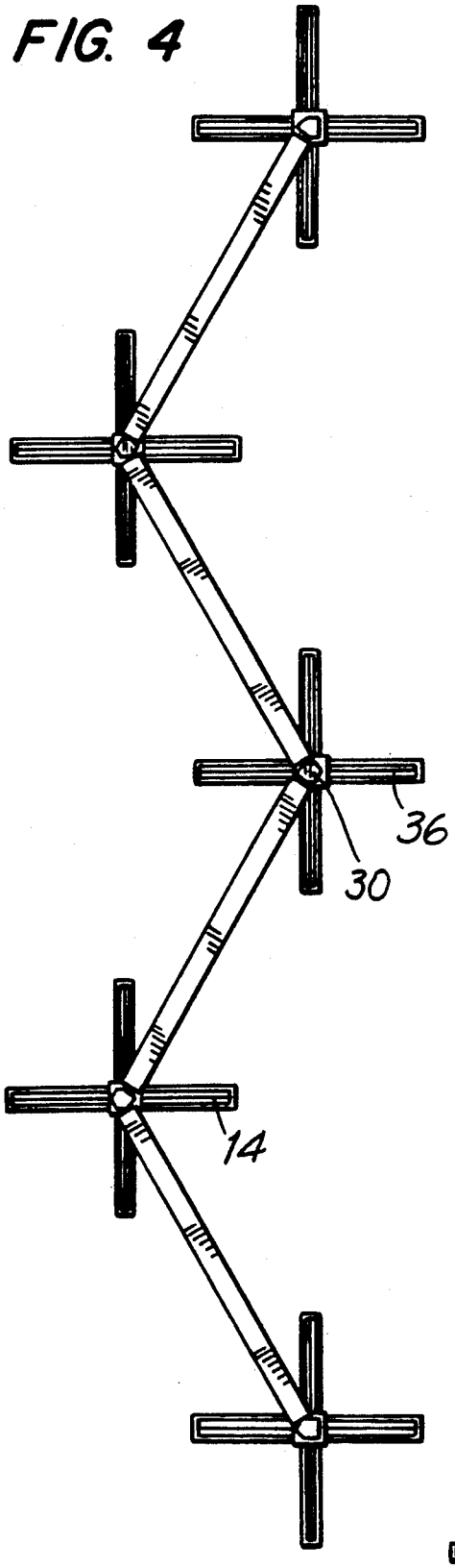
FIG. 5
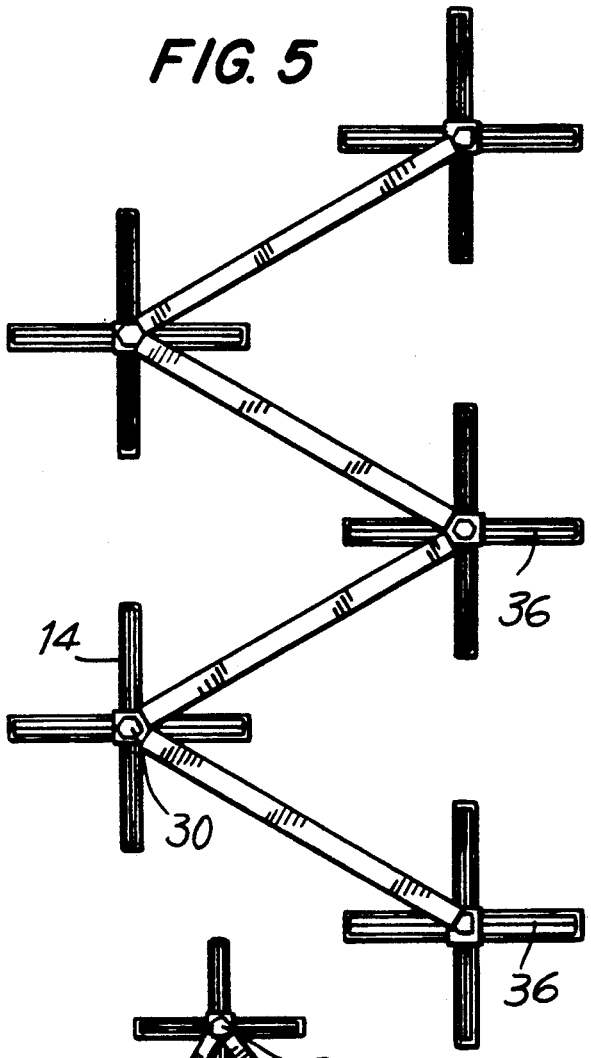
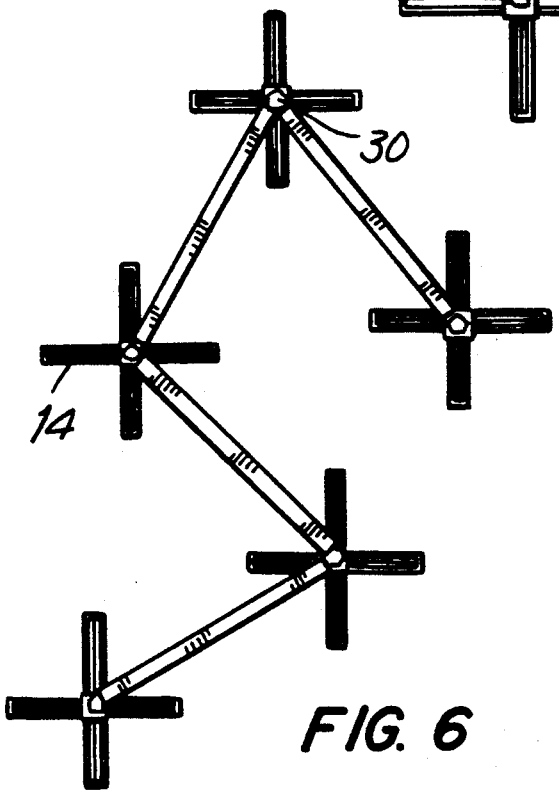
FIG. 6

I-FRAME SUPPORT FOR A ROTATABLE DISPLAY TOWER

BACKGROUND AND BRIEF DESCRIPTION OF THE INVENTION

The present invention relates to a display rack or system for displaying paperback books, hard cover books, over-sized books, LP records, audio cassette tapes, compact disks or other similar devices. The purpose to be accomplished by the present display rack is the presentation of a large multitude of consumer choices in a minimum of floor area while maintaining the ability of the consumer to view the eye-catching covers or fronts of the packaged books, tapes or disks, etc.

Basically the present invention is a set of I-shaped frames which support two or more towers or racks. Each tower is of a turntable type such that the consumer can stand in front of one and without moving his or her feet can turn the tower to view additional selections for consideration. Each tower has a series of arms, extending outwardly from the central rotating axis, for supporting one but, preferably, two or more possible selections. Each tower is preferably provided with a plurality of vertically spaced arms which provide even more additional possible selections to the consumer.

According to the preferred embodiment of the present invention, two or more I-shaped frames are hingedly secured together. The extreme ends of the entire display rack is provided with rotatable towers and the interior openings defined between connected I-frames also support rotatable towers. This ability of two or more I-frames to be connected together allows the store owner to display a large variety of purchasable items while still allowing the store owner to configure the display racks in a visually pleasing manner. In addition, the store owner can take into consideration the available floor space. Other considerations in arranging the I-frames and the towers enable obstacles to be avoided, e.g., pillars, stair cases, radiators, etc. Flexibility of display is an object sought to be accomplished by the present invention.

Years ago, readers browsed libraries, taking their time, carefully picking their way through the stacks to make just the right selection. Today, many libraries' patrons seem more like shoppers—selecting only those materials that are attractively and accessibly displayed. Consequently, library collections must have the same visual appeal and impact as the point-of-sale merchandising found in book, audio and video stores. The present invention is intended to display a wide variety of materials in large quantities, while preserving the consumer's ability to view the eye-catching covers of the materials.

The present invention basically comprises an I-frame structure which supports at least two turntable-like towers. Each tower has a plurality of arms which support the books, tapes and disks. The I-frame presents a multi-media display system that combines the appeal of retail with, the durability of more traditional library displays. The current system is designed to accommodate audio and video cassettes, CDs and paperbacks. The present display system effectively displays multimedia collections and makes collections, for sale or borrowing by the consumer, more attractive, interesting and accessible.

DESCRIPTION OF THE PRIOR ART

Rotatable towers are currently on the market which present books, both paperback and hardcover, video tapes, audio cassette tapes, compact disks, etc. in a visually pleasing manner to potential consumers. Basically, these towers stand alone, i.e., they present a single tower with a plurality of arms, but only one rotatable tower. When it is desired to present two or more such rotatable towers, in an integrated display, the towers are merely pushed closely together. They are, however, still independent of one another, i.e., they are generally individually supported on the floor by a base which provides the lower axis for rotation of the tower. U.S. Pat. No. 3,844,230 to Hudson et al. relates to a rotatable display rack having one or more rotatable towers. That device has a holder for the tower's top to facilitate stability and rotation thereof.

The present invention allows for a store owner or librarian to display two or more towers by use of a single base-like support. The display is thus more easily integrated. It thus provides for a superior display. For example, one tower of an I-frame can have audio cassette tapes of a set of titles while the immediately adjacent and integrated-together tower can present, in much the same order, the set of books corresponding to the same set of titles. In addition, as will be more fully explained, the area of the floor of the establishment, whether it be a library or retail store, is more effectively covered with the I-frame and towers. The system provides for maximization of display materials per unit of floor space while minimizing the generally unattractive bases of the prior art display towers. The present invention, as will be seen, provides two towers for each I-frame although hinged together I-frames share a common tower.

Other display racks or rotatable towers are, of course, available. Generally, however, as previously discussed, they provided a single support base for a single rotatable tower. Generally, there is no top support for the tower and this can result in a lack of stability to the rotating tower. The present invention, on the other hand, provides for a bottom and top support for each tower supported by the I-frame. The rotatable towers are thus better supported and easier to turn. The present invention provides display towers which are more enduring in the harsh marketplace and in the environment that these items are intended to be placed within. The I-frame of the present invention is particularly well suited for mounting display towers such as described in my companion applications Ser. No. 07/806720, filed Dec. 12, 1991 and Ser. No. 07/806714 filed Dec. 12, 1991. The I-frames provide great flexibility of in-store displays.

As mentioned, the prior art generally provides single towers on individual bases. The present invention, in contrast, provides two or more towers which are spaced apart by predetermined spacing. This allows for even an unexperienced store clerk to set up the device without worrying about visual appeal. Also, by using two or more I-frames together, i.e., three or more rotating towers, a wide variety of structural configurations are available. This allows the store clerk to extend the display system over a large or small area. A huge variety of visually appealing configurations, without worrying about spacing between towers in thus easily achieved. Furthermore, the connected-together I-frames allow for the display to be extended around obstacles e.g., pillars or other objects on the store's floor.

U.S. Pat. No. 3,844,230, shows a rotatable display rack for articles.

SUMMARY OF THE INVENTION

The present invention relates to an I-frame support for a pair of towers. When two or more of such I-frames are hingedly connected together, the number of towers is generally equal to one more than the total number of I-frames. Each I-frame has a vertically-directed, wide support beam, a top support and a floor engaging leg. At the ends of the top support and floor engaging legs are the bearings for support of the rods of the rotatable towers. The top support and floor engaging legs extend across the support beam. The floor engaging leg is provided with a pair of ground contact wheels for direct support on the floor. If only a single I-frame is used, the leg is provided with stability legs which extend perpendicularly to the floor engaging leg and provide additional ground contact surfaces for increased stability. Where two or more I-frames are used together, the floor engaging legs of the I-frames, themselves, provide the stability to the system to prevent accidental toppling of the system. More specifically, when two or more I-frames are connected together, the floor contacting legs are preferably oriented into angular orientations which do not exceed 120 degrees. This will basically ensure that the system does not topple.

Each I-frame has, at the ends of the top support and bottom leg, bearings for supporting the towers. The towers are rotatable by securement to a center rod, to which the tower arms are connected. The rod is secured into the bearings located at the center of the top support and floor engaging leg. The tower's arms, four being preferred for each vertical level, extend radially outward from the center rotatable rod and present bottom and top supports for the books, tapes, compact disks, etc. sought to be displayed. Of course, if desired, more than four tower arms can extend radially from the rotatable rod, at angles defined therebetween which are other than 90 degrees. It has been found, in practice, however, that four arms displaying merchandise is preferred and that the angular orientation between arms is preferably 90 degrees. In the preferred embodiment of the invention, eleven levels of merchandise are secured on each tower, thereby requiring sets of tower arms connected to the rotatable rod.

BRIEF DESCRIPTION OF THE DRAWINGS

FIG. 4 is a top plan view of the embodiment of the invention shown in FIG. 1 with the towers now shown in full lines, i.e., not in phantom.

FIG. 5 is a top plan view of the embodiment of the invention shown in FIG. 1, with the towers again shown in full lines, and, yet, this illustration shows a reconfiguration of the same I-frames and towers such that the distance from the extreme ends of the structure is less than that shown in FIGS. 1 and 4.

FIG. 6 is another top plan view of the embodiment of the invention shown in FIG. 1, with the towers again shown in full lines. This illustration shows yet another configuration of the I-frames and secured towers.

DETAILED DESCRIPTION OF THE DRAWINGS AND THE PREFERRED EMBODIMENT

Figure 1:
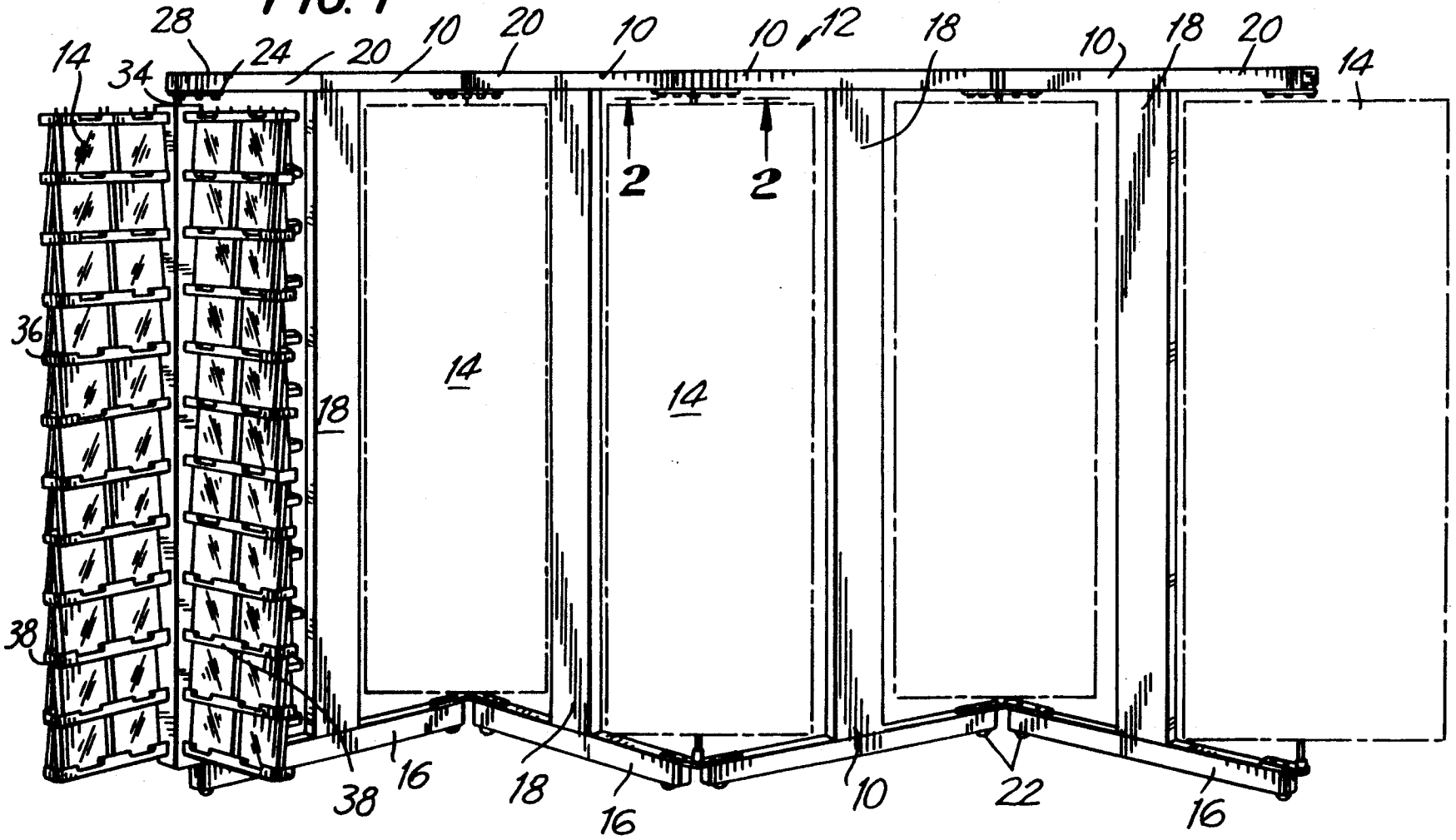
FIG. 1 is a perspective view of the present invention with four I-frames connected together. A first support tower is fully illustrated with the other four towers being shown in phantom. The shown tower is provided with forty-eight display arms, breaking the height of the tower into eleven vertically spaced levels. The twelve sets of support arms are rotatively supported on a single rod which is held by the bearings set in the ends of the top support and floor engaging leg of the I-frame.

As best seen in FIG. 1, four I-frames 10 are connected together to form a single integrated display system 12. Each I-frame is capable of supporting two rotatable towers 14. When two or more I-frames are connected together, the outermost two I-frames support one tower each, by themselves, and share the support of another tower with their adjacent I-frames. Interior I-frames thus share the support of towers. The total number of towers which can be supported by two or more I-frames is equal to the number of I-frames plus one. Thus, in the example shown in FIGS. 1 and 4–6, four I-frames support five rotatable towers.

Each I-frame 10 has a floor engaging leg 16, a vertical support beam 18 and a top support 20. The floor engaging leg 16 is preferably about three to four feet in overall length. It can, if desired, be provided with a set of casters 22, wheels, or simple button-like feet, for direct contact with the floor. The casters 22 are located at the ends of the floor engaging leg. Extending upwardly from about the center of the floor engaging leg 16 is the vertical support beam 18. In the preferred embodiment, the height of the vertical support beam 18 extends to about five feet above floor level. It is substantially flat on its faces and can be made from a two-by-six or two-by-eight piece of wood. The faces of the support beam 18 are desirably flush with the faces of the floor engaging leg 16. The top support 20 is similar in dimensions to the floor engaging leg 16 and is secured, by dowels, glue, or other conventional means to the top surface of the vertical support beam 18. As thus assembled, the vertical support beam 18, the floor engaging leg 16 and the top support 20 define an I-frame. FIG. 1 shown four such I-frames hingedly secured together for a display of five rotatable towers 24.

The ends of the top support 20 and the floor engaging leg 16 are provided with intermeshing hinge brackets for attaching I-frames and for securing the rotatable rods 34 therebetween. At one of the free ends 28 of I-frame 10 (see FIG. 1) a bracket 24 is secured by a pair of wood screws 26 to the top support 20. A receptacle-like knob 30, having an aperture 32, is provided on the top of the bracket and provides a hole within which the top end of the rod 34 is rotatively housed. In the preferred embodiment, the rod 34 extends through the bracket, through the aperture 32 and into the receptacle-like knob 30 (see FIG. 3). Bearings (not shown) are provided to facilitate ease of turning the towers but are not necessary at least for the top portion of the rod 34 in the top support. In the preferred embodiment the receptacle-like knob 30 has only an aesthetic-like purpose. More specifically, such knobs provide an unbroken line to the top of the frames and cover some unsightly hardware involved in the top hinge and bearing.

When two I-frames are connected together, one bracket member is held by wood screws 26 to the top support 20. It overlaps the extending bracket 23 from an adjacent I-frame (see FIG. 3) and it, too, is provided with an aperture through which rotative rod 34 passes into receptacle-like knob 30.

Figure 2:
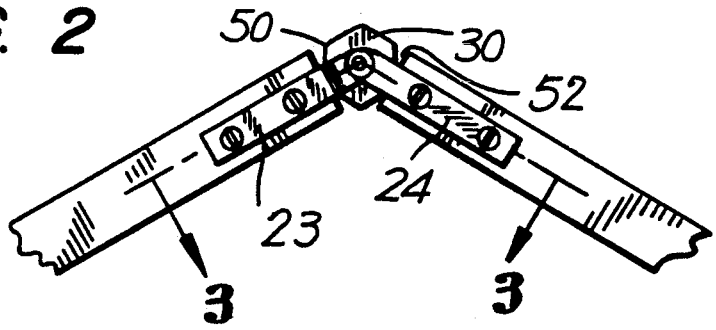
FIG. 2 is a partial cross-sectional view, taken along lines 2—2 of FIG. 1 and illustrates the hinge connection between adjacent I-frames.
Figure 3:
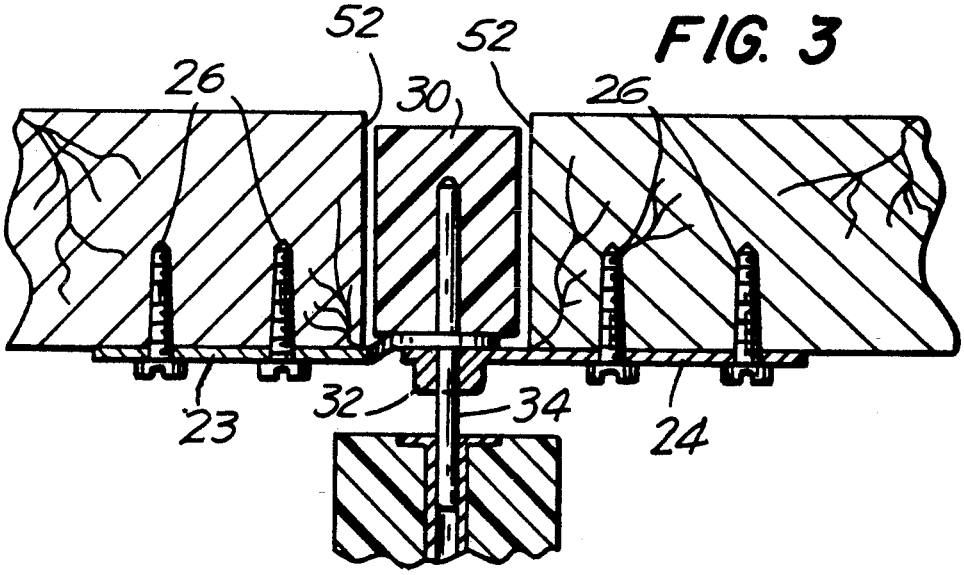
FIG. 3 is a partial cross-sectional view, taken along lines 3—3 of FIG. 2 and again illustrates the hinge connection between a pair of adjacent I-frames.

The brackets 23, 24 and apertures used for the floor engaging leg 16 of the I-frame 10, i.e., at the connection of two adjacent I-frames with a rod 34 therebetween, are substantially identical to that shown in FIGS. 2 and 3 described above. In the preferred embodiment, however, the bottom structure is provided with bearings for supporting the weight of the tower when it is fully loaded with merchandise. This facilitates the ease of rotating the tower about its vertical axis which, it should be appreciated, coincides with the rod 34.

Each rod is supportive of a tower 14, Each tower has a plurality of radially extending arms 36. In the preferred embodiment of the present invention, the towers 14 are provided with twelve vertically-spaced sets of arms thereby defining eleven levels of merchandise. The arms 36 do not form a part of the present invention but in the preferred embodiment each level of arms comprises four individual support racks 38. According to this embodiment, the support racks are two-sided such that merchandise is tilted backwardly for convenient viewing, yet back-to-back with additional merchandise. Also, according to the preferred embodiment, two or more articles of merchandise M are placed on each support rack, not including the back-to-back merchandise. In the embodiment of the invention shown in FIG. 1, each support rack thus supports four articles of merchandise, two adjacent to one another and two more back-to-back to the adjacent merchandise. The radially extending arms are provided with central apertures which are adapted to allow the rod 34 to pass therethrough and, yet, the arms 36 are fixedly secured to the rod 34. Rotation of the arms causes the rod 34 to rotate within the apertures of the brackets. The arms 36 are also provided with vertical spacers to space one level of arms from the vertically above or below arms.

Figure 7:
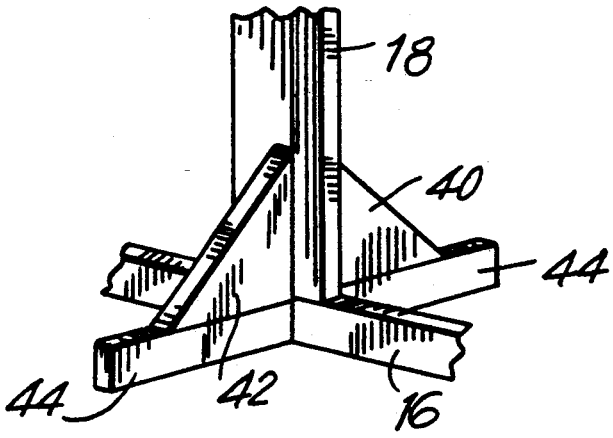
FIG. 7 is a partial perspective view of a base of an I-frame. This is an alternate embodiment useful where the I-frame is not intended to be connected to additional I-frames. This configuration provides additional support and stability to the I-frames and minimizes the potential for the display racks to inadvertently topple.

In the embodiment of the invention shown in FIG. 7, the vertical support beam 18, with the floor engaging leg 16 is provided with additional supporting legs 40 and 42. These legs are intended to provide additional stability to an individual I-frame 10 if it should desirably be used by itself, i.e., without being connected to additional I-frames. In this embodiment, the I-frame 10 would have a tendency to topple unless provided with the supporting legs 40 and 42. In the preferred embodiment, the supporting legs 40 and 42 comprise base members 44 which are connected to the floor engaging leg 16 by dowels, nails, gluing, etc., i.e., by securing them at right angles to the line defined by the floor engaging leg 16. Vertical supports 46, also made from wood, in the preferred embodiment, are triangularly shaped and extend between the vertical support beam 18 and the base members 44. As thus constructed, the supporting legs 40 and 42 allow a single I-frame to stand alone, without unnecessary instability. These legs can also be used with connected together I-frames, too.

In accordance with another embodiment of the invention, and as best seen in FIGS. 2 and 3, the receptacle-like knob 30 has a perimeter surface 50 which is adapted to fit between the flat ends 52 of the top support 20. The shape and dimension of the knob 30 is such as to prevent the I-frame, when connected to another I-frame, from inadvertently being closed together or opened too far for safety. If that were allowed to occur, then a consumer, for example, could accidentally push one I-frame toward an attached, stationary, I-frame and either topple the display system or create a probability of toppling. The knob 30 can be a removable and selectively installed mechanism onto the exposed end of the rod and different size knobs can be used to ensure various minimum and/or maximum angles between adjacent I-frames. As can be seen from FIG. 2, the knob 30 prevents an angle of more than about 120 degrees from being defined between adjacent I-frames.

As can be seen in FIG. 4 through 6, the display system 12, comprised of four I-frames and five towers 14 can take a variety of floor configurations. For example, in FIG. 4, the I-frames define angles, when viewed from above, of about 120 degrees with one another. The knobs 30 are adapted to be installed to ensure this configuration. FIG. 5, on the other hand, shows the same I-frames and towers and, yet, here the angles between adjacent I-frames are maintained at about 60 degrees. This, too, is a stable configuration. The flexibility of the system allows the merchandiser to conform to the floor space and physical limitations of the environment of the store. FIG. 6 shown yet another configuration of the I-frames and towers. At any or all I-frames, additional supporting legs 40 and 42 can be provided/ they are especially important when angles of more than 120 degrees are desired.

It will be appreciated that the embodiments described herein along with the drawings, are illustrative of the invention, the scope of the invention being defined by the claims as interpreted by the Courts.

What is claimed is:

1. A rotatable tower display system for a plurality of articles comprising two or more I-frames, each of which is defined by a floor engaging horizontally extending base leg, a vertical support beam extending upwardly from the center of said base leg, and a top support horizontally extending across said vertical support beam and parallel to said base leg, the ends of said base leg and said top support defining at their distal ends two pairs of opposed free ends, a tower supporting means located at each pair of opposed free ends, and at least two rotatable display towers, each comprising at least two vertically spaced shelves, said shelves extending radially from a common axis of rotation, said display towers being rotatively secured by said tower supporting means for rotation about said common axis of rotation, said distal ends of said base leg and said top support being located further from said vertical support beam than the distance from said axis of rotation to the end of said shelves, adjacent I-frames being hingedly connected together by brackets extending from said free ends of each adjacent I-frame, said brackets also providing said tower supporting means.

2. A rotatable tower display system for a plurality of articles, comprising, two or more I-frames, each of which is defined by a floor engaging, horizontally extending base leg, a vertical support beam extending upwardly from the center of said base leg, and a top support horizontally extending across said vertical support beam and parallel to said base leg, the ends of said base leg and said top support defining at their distal ends two pairs of opposed free ends, a tower supporting means located at each pair of opposed free ends, and at least two rotatable display towers, each comprising at least two vertically spaced shelves, said shelves extending radially from a common axis of rotation, said display towers being rotatively secured by said tower supporting means for rotation about said common axis of rotation, said distal ends of said base leg and said top support being located further from said vertical support beam than the distance from said axis of rotation to the end of said shelves, two or more I-frames being hingedly connected together and adjacent I-frames being capable of defining angles between them from a minimum of about 60 degrees to a maximum of about 120 degrees.

3. A rotatable tower display system for a plurality of articles, comprising, two or more I-frames, each of which is defined by a floor engaging, horizontally extending base leg, a vertical support beam extending upwardly from the center of said base leg, and a top support horizontally extending across said vertical support beam and parallel to said base leg, the ends of said base leg and said top support defining at their distal ends two pairs of opposed free ends, a tower supporting means located at each pair of opposed free ends, and at least two rotatable display towers, each comprising at least two vertically spaced shelves, said shelves extending radially from a common axis of rotation, said display towers being rotatively secured by said tower supporting means for rotation about said common axis of rotation, said distal ends of said base leg and said top support being located further from said vertical support beam than the distance from said axis of rotation to the end of said shelves, two or more I-frames being hingedly connected together and adjacent I-frames being limited in their relative angular orientation by angle limiting means secured at the interconnection between said adjacent I-frames.

4. A display system as claimed in claim 3 wherein said angle limiting means is a know having a perimeter surface of a shape and dimension to define angular limitations of orientation between adjacent I-frames.

5. A display system as claimed in claim 4 wherein said angle limiting means are selectively interchangeable.

6. A rotatable tower display system for a plurality of articles, comprising, two or more I-frames, each of which is defined by a floor engaging, horizontally extending base leg, a vertical support beam extending upwardly from the center of said base leg, and a top support horizontally extending across said vertical support beam and parallel to said base leg, the ends of said base leg and said top support defining at their distal ends two pairs of opposed free ends, a tower supporting means located at each pair of opposed free ends, and at least two rotatable display towers, each comprising at least two vertically spaced shelves, said shelves extending radially from a common axis of rotation, said display towers being rotatively secured by said tower supporting means for rotation about said common axis of rotation, said distal ends of said base leg and said top support being located further from said vertical support beam than the distance from said axis of rotation to the end of said shelves, two or more I-frames being hingedly connected together and the vertical axis of said hinge connection coinciding with the rotative axis of said tower supported by said tower supporting means.

* * * * *